US011702908B2

(12) United States Patent
Stolboushkin

(10) Patent No.: US 11,702,908 B2
(45) Date of Patent: Jul. 18, 2023

(54) ALL MECHANICAL COUNTER DART, SYSTEM AND METHOD

(71) Applicant: Eugene Stolboushkin, Houston, TX (US)

(72) Inventor: Eugene Stolboushkin, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/225,348

(22) Filed: Apr. 8, 2021

(65) Prior Publication Data

US 2022/0325606 A1 Oct. 13, 2022

(51) Int. Cl.
*E21B 34/14* (2006.01)

(52) U.S. Cl.
CPC ..... *E21B 34/142* (2020.05); *E21B 2200/06* (2020.05)

(58) Field of Classification Search
CPC ..... E21B 34/14; E21B 34/142; E21B 2200/06
See application file for complete search history.

(56) References Cited

U.S. PATENT DOCUMENTS

2011/0284240 A1* 11/2011 Chen ..... E21B 34/14 166/334.1
2012/0048556 A1* 3/2012 O'Connell ..... E21B 34/063 166/308.1
2013/0206402 A1* 8/2013 Coon ..... E21B 34/14 166/305.1
2018/0328144 A1* 11/2018 Arabsky ..... E21B 23/006
2020/0318458 A1* 10/2020 Godfrey ..... E21B 23/03

* cited by examiner

*Primary Examiner* — Christopher J Sebesta
(74) *Attorney, Agent, or Firm* — Cantor Colburn LLP

(57) ABSTRACT

An all mechanical counter dart including a mandrel, a plurality of shoulder members disposed upon the mandrel and movable from a more downhole portion of the mandrel to a more uphole portion of the mandrel, individual ones of the plurality of shoulder members moving from an inactive position to an active position and back to an inactive position while traversing the mandrel, and an upset on the mandrel supporting the individual ones of the plurality of shoulder members when in the active position.

18 Claims, 9 Drawing Sheets

ALL MECHANICAL COUNTER DART, SYSTEM AND METHOD

BACKGROUND

In the resource recovery and fluid sequestration industry, many fracture stages are often required. Traditionally, objects such as balls or darts are used in a step-up manner to actuate particular landing features. For example, traditional means include using a smallest diameter ball of a set of balls first to reach a downholemost landing feature and then stepping up in diameter, usually by 1/16 inch increments for each adjacent landing feature moving to a least downhole landing feature. The number of stages possible with this traditional method becomes limited at an upper limit by a diameter of the string in which the landing features reside and at a lower limit by practicality of how small a landing feature can be while still allowing sufficient flow while open to allow well operations. The art would like to reduce the limitations on number on fracture stages in a wellbore.

SUMMARY

An embodiment of an all mechanical counter dart including a mandrel, a plurality of shoulder members disposed upon the mandrel and movable from a more downhole portion of the mandrel to a more uphole portion of the mandrel, individual ones of the plurality of shoulder members moving from an inactive position to an active position and back to an inactive position while traversing the mandrel, and an upset on the mandrel supporting the individual ones of the plurality of shoulder members when in the active position.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
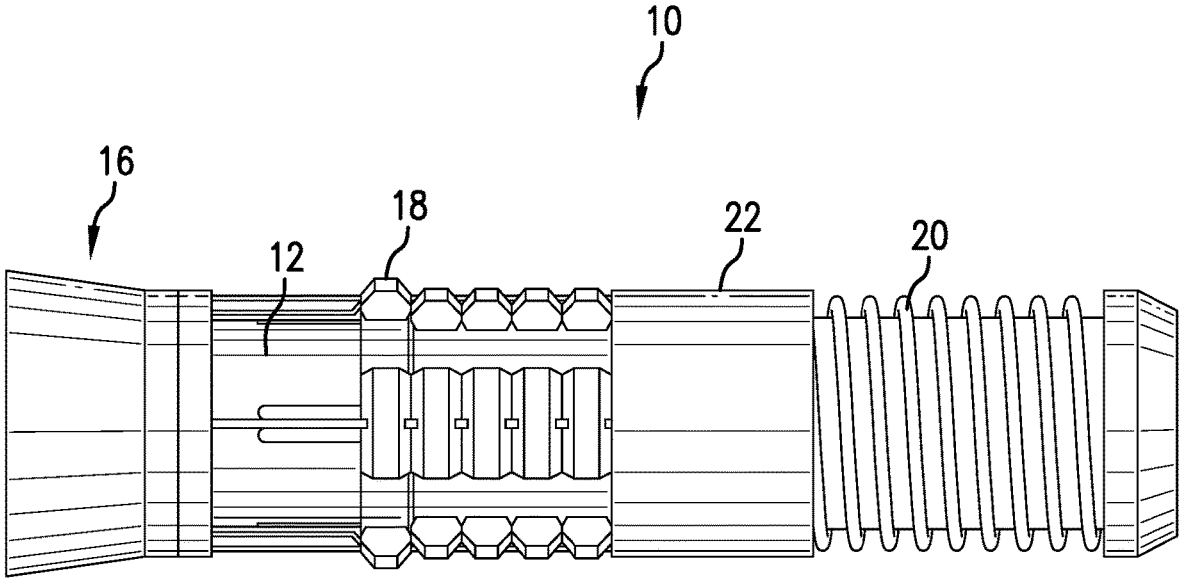
FIG. 1 is a side view of a first embodiment all an mechanical counting frac dart as disclosed herein.
Figure 2:
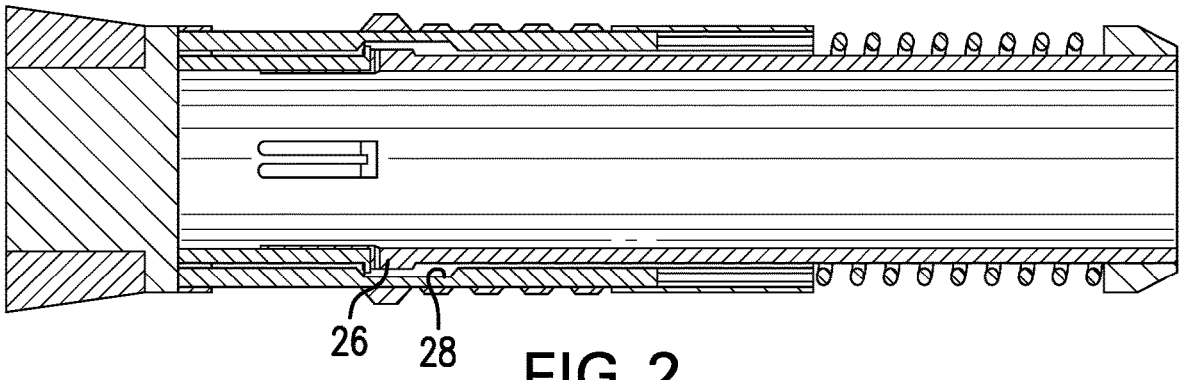
FIG. 2 is a cross section view of the embodiment of FIG. 1.
Figure 3:
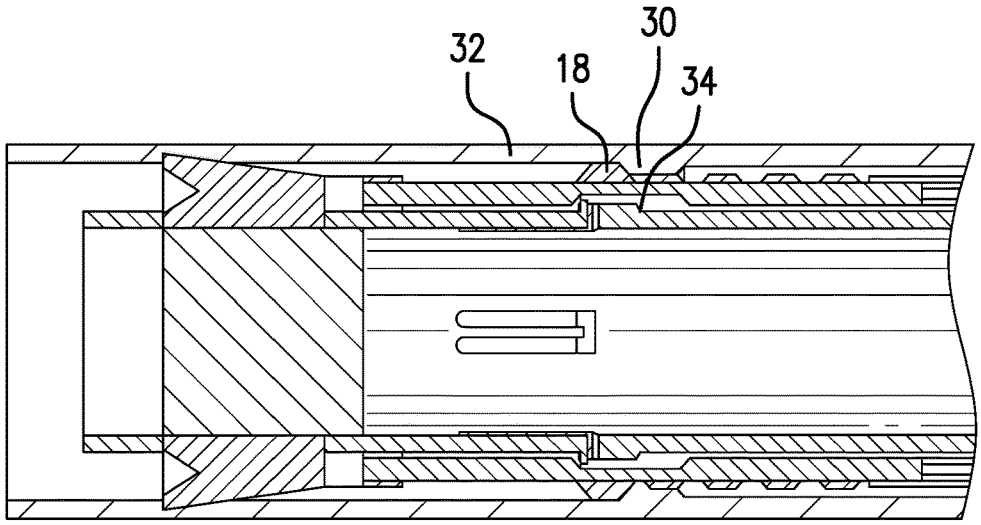
FIGS. 3-6 show the dart of FIG. 1 in various positions.

Referring to FIG. 1, an all mechanical counting dart 10 is illustrated. Dart 10 includes a mandrel 12 having an upset 14 thereon. The mandrel 12 is connected at an uphole end to a plug 16. Plug 16 provides for differential pressure uphole and downhole of the plug 16. Any conventional plug may be incorporate in the dart 10. Disposed about the mandrel are a plurality of shoulder members 18 that are movable from a more downhole position relative to the dart 10 and a more uphole position relative to the dart 10. The shoulder members 18 may be dogs, or C-rings, or other radially displaceable configuration having similar functional attributes. Aiding in their movement, is a biasing member 20. In some embodiments the biasing member 20 may be separated from the shoulder members 18 by a spacer ring 22. Helping to keep alignment of the shoulder members 18 and selectively limiting radial movement thereof are guide rails 24 extending from the ring 22 to the plug 16. It should be noted that the guide rails 24 are slidably received in the ring 22 so that the ring 22 may be urged toward the uphole end of the dart 10 under the influence of the biasing member 20. This ring 22 or the biasing member directly, is what causes the plurality of shoulder members to move in the uphole direction relative to the dart 10 at all times when such movement is possible. Reference to FIGS. 2 and 3 will help understanding of the last sentence. In FIG. 2, which is a section view of FIG. 1, one can ascertain that a shoulder member 18 is radially outwardly displaced relative to the other members 18. This may be one member or a set of members that are disposed about the dart circumferentially as is depicted. It is to be noted that the member 18 that is displaced radially outwardly is in such a position because it has ridden up on the upset 14 of mandrel 12. The member 18 is permitted to move radially outwardly when riding up the upset 14 due to an undercut 28 in the guide rail 24. In portions of the guide rails 24 where there is no undercut 18, the members 18 are maintained in their radially inward positions.

Figure 4:
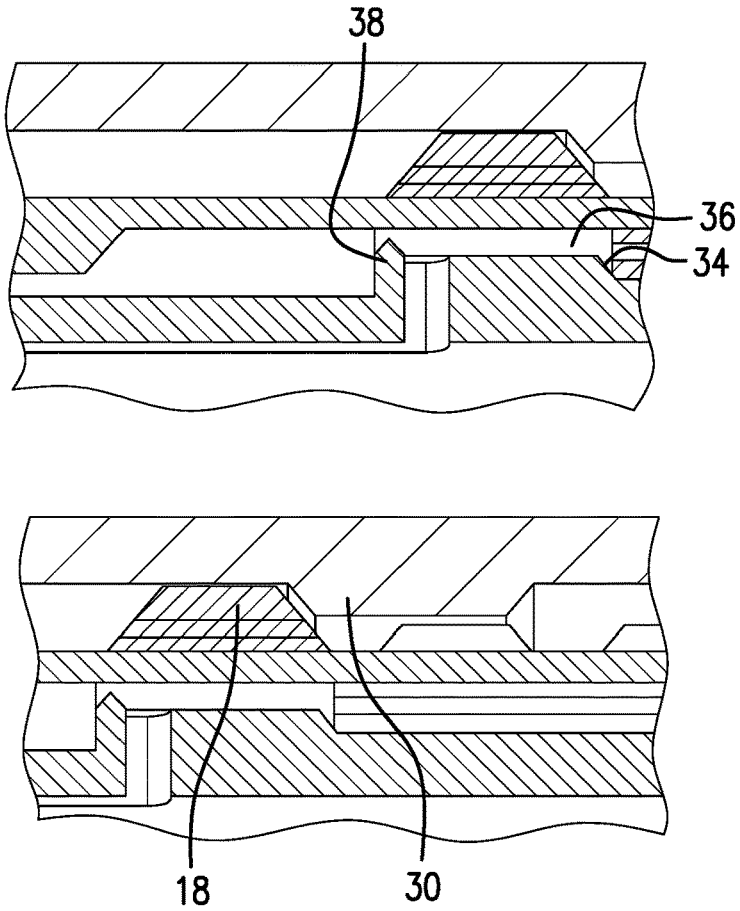
Figure 5:
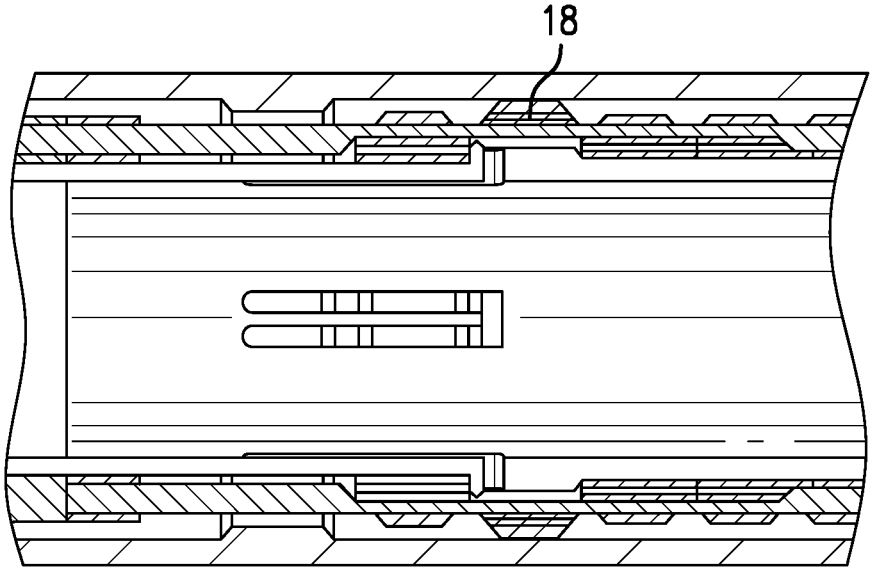
Figure 6:
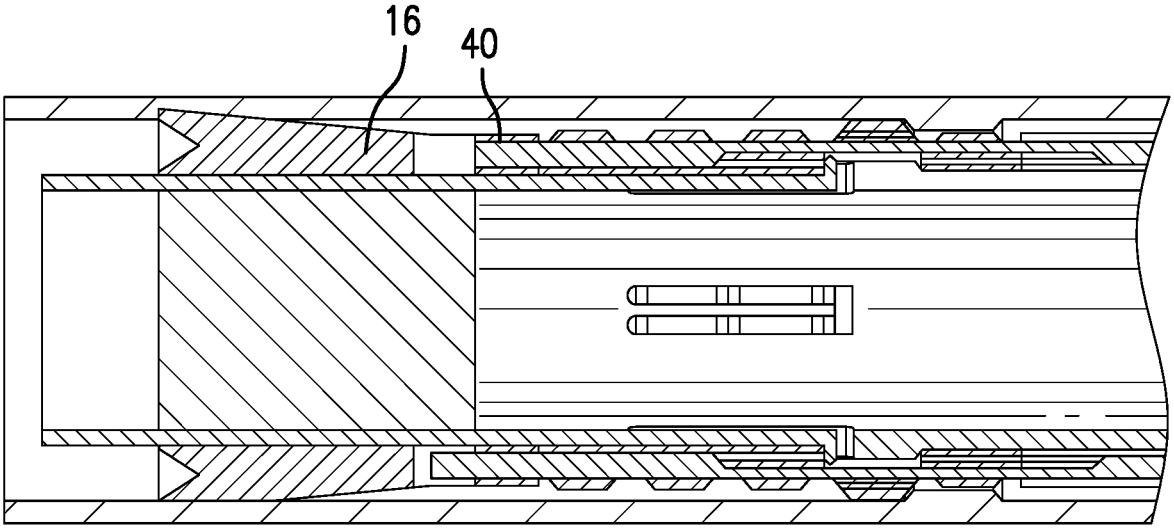

Referring to FIGS. 3 and 4, the radially outward position of the member 18 is shown interacting with a profile 30 of a sleeve 32 such as a frac sleeve. In the illustration it is the first member 18 that is interacting with the profile 30 but the same sequence of events will apply to sleeves 32 as the dart moves downhole until the selected number of sleeves 32 have been passed and the correct sleeve 32 (identified by count) has been engaged. Initial operation will have the first member 18 urged toward the uphole end of the dart 10 by the biasing member 20. As member 18 moves in this direction, it reaches the undercut 28 of guide rail 24 and hence can move radially outwardly. Next the member 18 encounters the upset 14. Upset 14 includes a ramp 34 having an angle that allows the member 18 to move radially outwardly to a crest 36 of the upset 14. The ramp angle is about 45 to 60 degrees in embodiments. In this position, seen best in FIG. 4, the interaction of the member 18 with the profile 30 is clear. Fluid pressure behind the plug 16 will load the member 18 into the profile 30. The load holding capability is specifically limited however. A stop detent 38 is engaged with the member 18 in this position and it is this detent alone (or the number of detents about the circumference engaging the same circumferential group of shoulder members 18) that allows load to be carried between the member 18 and the profile 30. When a design threshold is exceeded on the stop detent 38, the detent 38 will deflect radially inwardly, thereby releasing the member 18. This allows member 18 to move further in the uphole direction of the dart 10 and off of the crest 36. Without the upset 14 supporting the member 18 in the radially outwardly displaced position, the member 18 will move radially inwardly. Radially inward movement of the member 18, causes a disengagement with the profile 30 and the dart to count the sleeve 32 and move to the next (downhole adjacent) sleeve 32. As member 18 moves further uphole, it will exit the undercut 28 and be retained radially inwardly again by the guide rail 24. Meanwhile, the second member 18, see FIG. 5, has been urged radially outwardly by the upset 14 just as the first member 18 had been previously. In the position shown in FIG. 5, the member 18 is ready to land upon the next (downhole adjacent) profile 30. The entire sequence will repeat until the shoulder members 18 are stacked next to one another in the portion of the dart 10 uphole of the upset 14 taking up all of the available space. At this point, the stop detent is not the limiting factor for load holding capability but rather the stacked up members 18 provide great load holding capacity, well above what is needed for a pressure differential across plug 16 to shift the selected sleeve 32. The dart will have selected the particular sleeve 32 based upon the available space in the portion of the dart uphole from the upset 14. The position just described may be viewed in FIG. 6. All of the space between the plug 16 or a spacer 40 and the upset 14 is taken up by members 18 stacked against each other. Selecting a particular sleeve 32 is as easy as adding a spacer 40 (before running the dart 10) to change the amount of space available between the spacer and the upset 14. The spacer 40 may be a snap in ring, a slidable ring, a threaded ring, or equivalent. In embodiments, it also may be that set screws or rods could be placed in holes along the mandrel between the upset 14 and the plug 16 to select the space available. As long as the space available for stack up of shoulder members 18 can be adjusted, the dart 10 will be easily programmable to select a particular sleeve 32 by counting the number of sleeves 32 before the desired one.

Figure 7:
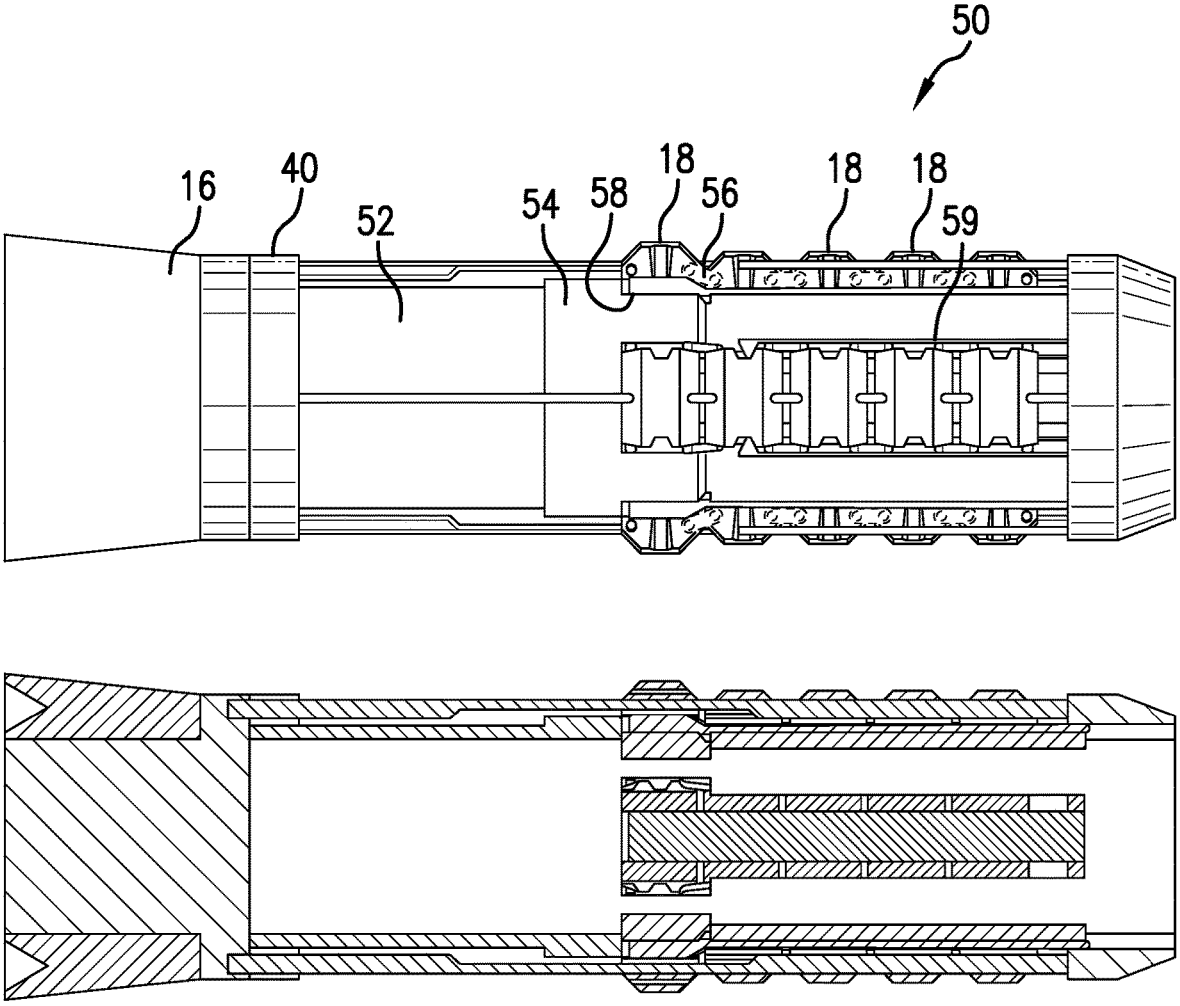
FIG. 7 is a side view of a second embodiment of an all mechanical counting dart as disclosed herein.
Figure 8:
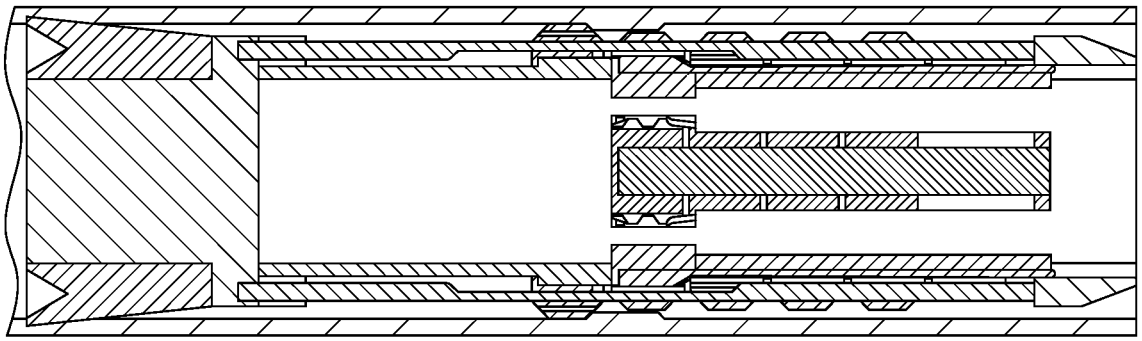
FIGS. 8-13 show the dart of FIG. 8 in various positions.

In another embodiment, referring to FIGS. 7 and 8, a dart 50 includes a mandrel 52 having an upset 54 thereon. Upset 54 is configured differently than upset 14 but retains its essential function of supporting a member 18 in a radially outward position to engage the profile 30 of the next sleeve 32 to be passed. Because in this embodiment, there is no biasing member 20, the passing of profiles 30 must move the members 18 toward the uphole portion of dart 50. This requires that the members 18 be interconnected by a tether 56. Tethers may be chain link, cable, etc. and will be specifically configured to fail at a predetermined load. Assisting in the operation is a detent arm 59 that resists movement of the members 18 in the uphole direction relative to the dart 50 until a threshold force is applied. This tends to prevent bunching of the tether. A threshold force contemplated is 10 pounds or more.

Figure 9:
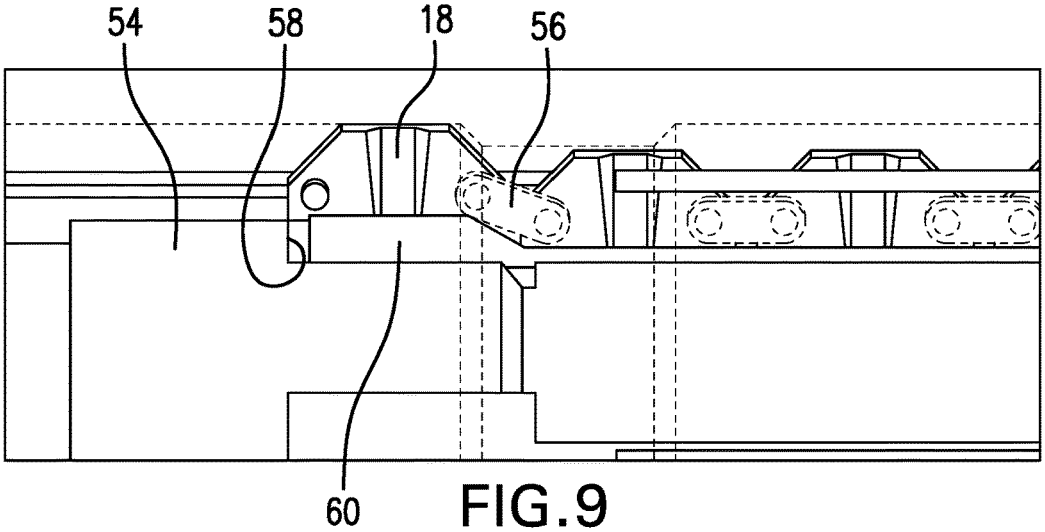
Figure 10:
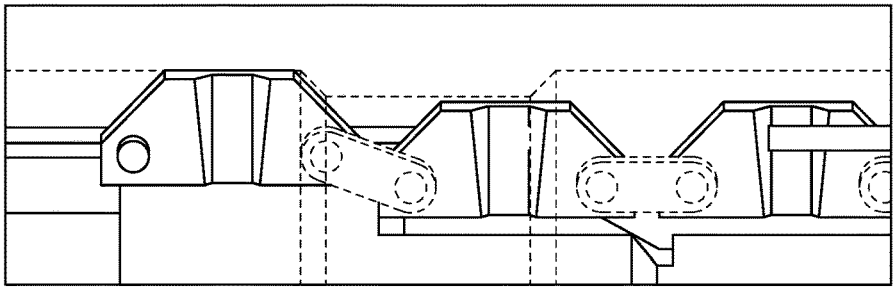
Figure 11:
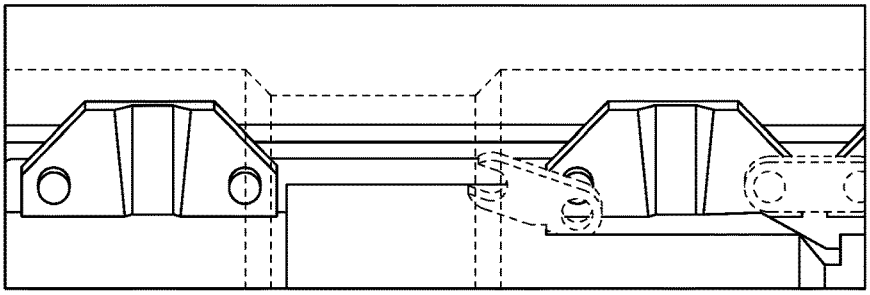
Figure 12:
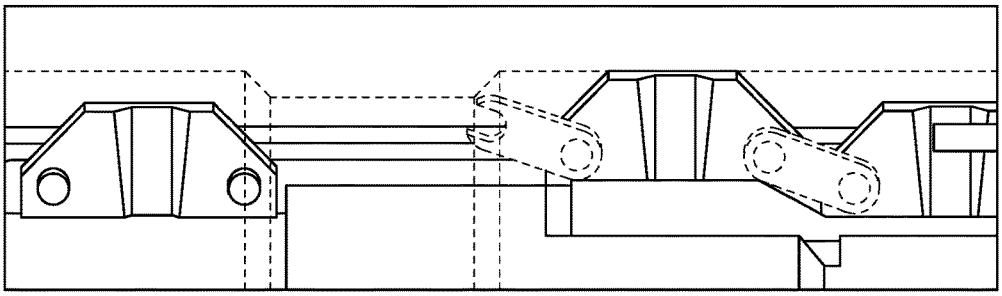
Figure 13:
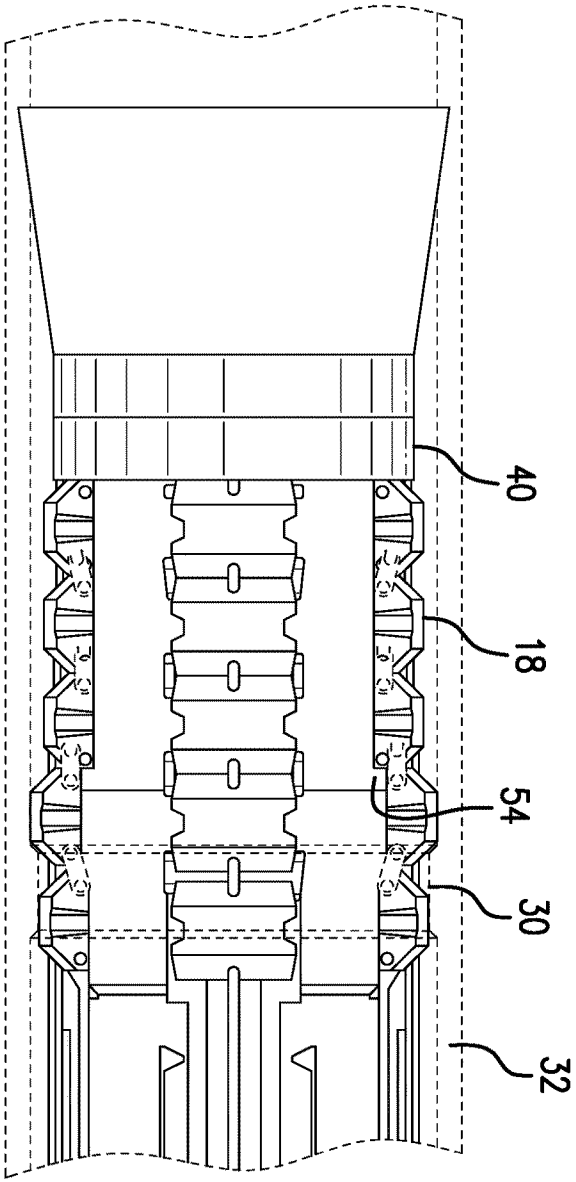
Figure 14:
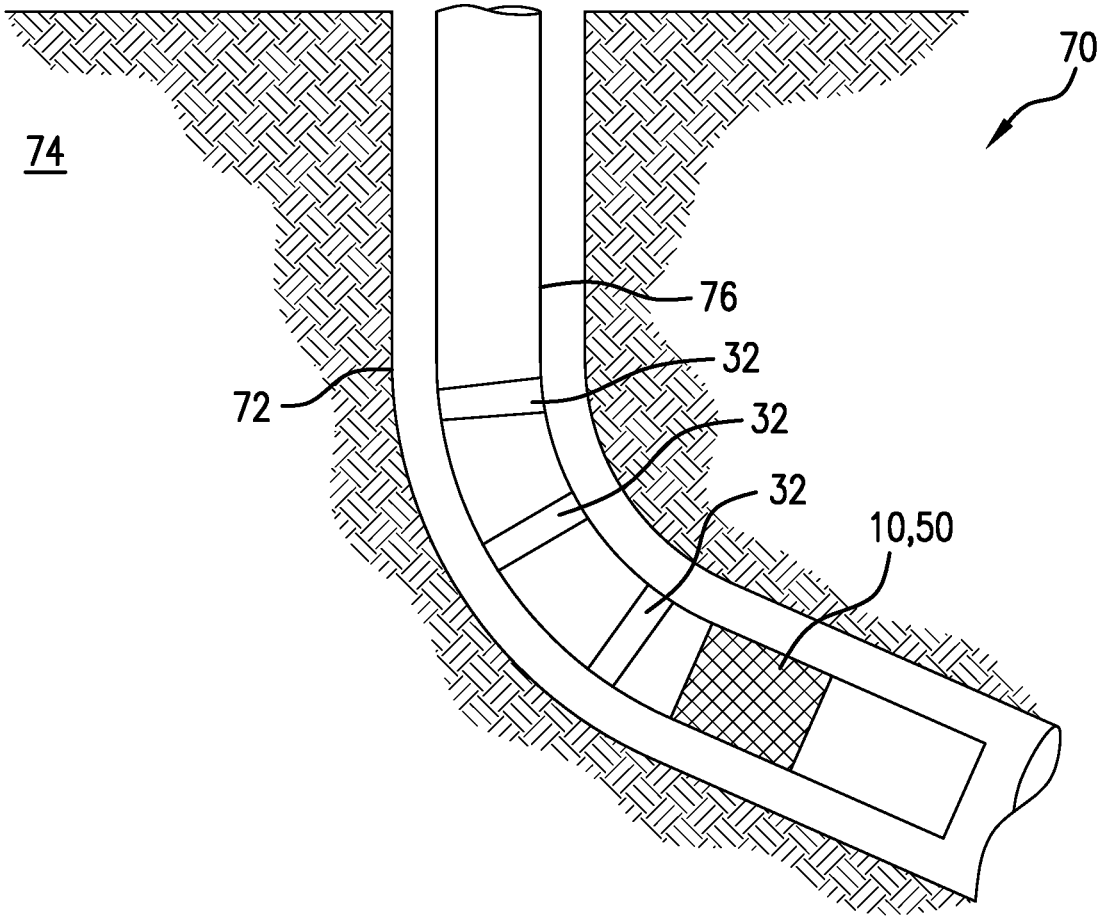
FIG. 14 is a schematic view of a wellbore system including an all mechanical counting dart as disclosed herein.

The difference in motive force for the members 18 also requires some geometrical changes to the upset 54 over upset 14, visible in enlarged FIG. 9, There is no ramp on upset 54 because an orthogonal surface 58 of upset 54 is used to provide a load path between the first member 18 and the next member 18 whereby the tether is released by exceeding the load capability of the tether 56. Because of the lack of an on-board biasing member and a ramp, a lifter 60 is disposed in the dart 50, The lifter 60 may be a collet or other deflecting member and may be a part of the mandrel 52 or a separate structure attached to the dart 50. In either case, the lifter 60 is deflected radially inwardly by a next member 18 while a first member 18 is in the radially outward position and ready to engage the next profile. The profile is what causes the radially inward deflection of the lifter 60 by contacting the next member 18 at the inside diameter of the profile 30. The tether is still intact in this condition and the next member 18 that is disposed upon the radially inwardly deflected lifter 60 is also abutting the surface 58. The tether 56 then must bear the load of the dart 50 being hydraulically forced in the downhole direction while the first member 18 is seated on the profile 30. When the design parameter of tether 56 is exceeded, the first member 18 is free to move relative to the dart 50 and so as the dart 50 moves in the downhole direction, the first member 18 will move to a position in which it is unsupported by the upset 54 and collapse radially inwardly similar to the last embodiment. The dart 50 continues to move downhole and the second member 18 will move past the inside diameter of profile 30, which will allow the lifter 60 to move the second member 18 radially outwardly and into a position of support on the upset 54. In this position, the second member 18 is ready to land on the next adjacent profile 30 and the sequence will repeat until, like in the previous embodiment, there is no longer any room between the upset 54 and the plug 16 or spacer 40. The foregoing can be easily followed visually in the sequence of positions illustrated in FIGS. 9-12, the overall operation and its similarity to the foregoing embodiment will be apparent. In FIG. 9, the first member 18 is disposed radially upon the upset 54 and loaded against profile 30 of a first sleeve 32. The final position of the dart 50 is illustrated in FIG. 13, where it can be appreciated that members 18 have filled the available space between upset 54 and spacer 40 such that the depicted profile 30 has been selected and that sleeve 32 will be moved by the dart 50.

It is to be appreciated that one or more of the components of the darts 10, 50 as described may comprise a degradable material such as a controlled electrolytic material available from multiple commercial sources in which case the one or more components may be easily dissolved away in a pre-selected amount of time or by other degrade-on-demand paradigm to leave the wellbore free of debris or components needing to be removed from the well.

In use, either of the described embodiments of dart 10, 50 are configured ("programmed") at surface before running simply by adding an appropriate spacer 40 or adjusting space in one of the other ways and the dart is loaded into the wellbore and run. The dart automatically lands on, releases, and counts profiles 30 until the selected count is reached and then the next profile 30 is not released but rather the selected sleeve 32 is opened or closed depending upon the operation, which may be a frac operation.

Referring to paragraph 14, a wellbore system 70 is illustrated. The system 70 comprises a borehole 72 in a subsurface formation 74. A string 76 is disposed in the borehole 72. A dart 10, 50 is disposed in the string 76. In this system 70 there may be a number of sleeves 32, which may be fracture sleeves.

Set forth below are some embodiments of the foregoing disclosure:

Embodiment 1: An all mechanical counter dart including a mandrel, a plurality of shoulder members disposed upon the mandrel and movable from a more downhole portion of the mandrel to a more uphole portion of the mandrel, individual ones of the plurality of shoulder members moving from an inactive position to an active position and back to an inactive position while traversing the mandrel, and an upset on the mandrel supporting the individual ones of the plurality of shoulder members when in the active position.

Embodiment 2: The dart as in any prior embodiment further comprising an alignment configuration maintaining alignment of the plurality of shoulder members and permitting radial movement of individual ones of the plurality of shoulder members at a selected position.

Embodiment 3: The dart as in any prior embodiment, wherein the mandrel includes a stop detent arranged to interact with one of the plurality of shoulder members in the active position until a selected load threshold on the one of the plurality of shoulder members is exceeded.

Embodiment 4: The dart as in any prior embodiment, wherein the stop detent is a collet.

Embodiment 5: The dart as in any prior embodiment, wherein the mandrel includes a defined longitudinal length uphole of the upset such that only a selected number of the plurality of shoulder members may physically fit in the longitudinal length.

Embodiment 6: The dart as in any prior embodiment, wherein the longitudinal length is adjustable.

Embodiment 7: The dart as in any prior embodiment, wherein the wherein the adjustability is by a spacer.

Embodiment 8: The dart as in any prior embodiment, wherein the wherein the adjustability is by a threaded or slidable stop.

Embodiment 9: The dart as in any prior embodiment further comprising a biasing member urging the plurality of shoulder members toward and past the upset in an uphole direction.

Embodiment 10: The dart as in any prior embodiment, wherein the plurality of shoulder members are dogs.

Embodiment 11: The dart as in any prior embodiment, further comprising a lifter to radially outwardly displace individual ones of the plurality of shoulder members to a position where those individual ones of the plurality of shoulder members is supported by the upset.

Embodiment 12: The dart as in any prior embodiment, wherein the plurality of shoulder members are tethered to one another.

Embodiment 13: A method for counting frac sleeves and selecting a predetermined one frac sleeve in a set of frac sleeves including running a dart as in any prior embodiment into a borehole, landing a first shoulder member of the plurality of shoulder members on a frac sleeve, moving the first shoulder member off of the upset to an uphole end of the dart and releasing the frac sleeve, and repeating the moving and releasing with subsequent shoulder members of the plurality of shoulder members until there is insufficient space uphole of the upset to permit another shoulder member of the plurality of shoulder members to move off of the upset.

Embodiment 14: The method as in any prior embodiment further comprising shifting a selected frac sleeve, the selection being by virtue of the space uphole of the upset.

Embodiment 15: The method as in any prior embodiment further comprising, adjusting the dart by selecting the space uphole of the upset.

Embodiment 16: The method as in any prior embodiment, wherein the selecting is by adding a spacer to the dart.

Embodiment 17: The method as in any prior embodiment, wherein the moving and releasing is automatic.

Embodiment 18: A wellbore system including a borehole in a subsurface formation, a string in the borehole, and a dart as in any prior embodiment disposed in the borehole.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An all mechanical counter dart comprising:

a mandrel movable relative to a profile on a downhole actuation point;

a plurality of shoulder members disposed upon the mandrel and movable from a more downhole portion of the mandrel to a more uphole portion of the mandrel, individual ones of the plurality of shoulder members moving from an inactive unsupported position to an active supported position and back to an inactive unsupported position while traversing the mandrel in the same direction; and an upset on the mandrel supporting the individual ones of the plurality of shoulder members when in the active position.

2. The dart as claimed in claim 1 further comprising an alignment configuration maintaining alignment of the plurality of shoulder members and permitting radial movement of individual ones of the plurality of shoulder members at a selected position.

3. The dart as claimed in claim 1 wherein the mandrel includes a stop detent arranged to interact with one of the plurality of shoulder members in the active position until a selected load threshold on the one of the plurality of shoulder members is exceeded.

4. The dart as claimed in claim 3 wherein the stop detent is a collet.

5. The dart as claimed in claim 1 wherein the mandrel includes a defined longitudinal length uphole of the upset such that only a selected number of the plurality of shoulder members may physically fit in the longitudinal length.

6. The dart as claimed in claim 5 wherein the longitudinal length is adjustable.

7. The dart as claimed in claim 6 wherein the wherein the adjustability is by a spacer.

8. The dart as claimed in claim 6 wherein the wherein the adjustability is by a threaded or slidable stop.

9. The dart as claimed in claim 1 further comprising a biasing member urging the plurality of shoulder members toward and past the upset in an uphole direction.

10. The dart as claimed in claim 1 wherein the plurality of shoulder members are dogs.

11. The dart as claimed in claim 1 further comprising a lifter to radially outwardly displace individual ones of the plurality of shoulder members to a position where those individual ones of the plurality of shoulder members is supported by the upset.

12. The dart as claimed in claim 1 wherein the plurality of shoulder members are tethered to one another.

13. A method for counting frac sleeves and selecting a predetermined one frac sleeve in a set of frac sleeves comprising:

running a dart as claimed in claim 1 into a borehole;

landing a first shoulder member of the plurality of shoulder members on a frac sleeve;

moving the first shoulder member off of the upset to an uphole end of the dart and releasing the frac sleeve; and repeating the moving and releasing with subsequent shoulder members of the plurality of shoulder members until there is insufficient space uphole of the upset to permit another shoulder member of the plurality of shoulder members to move off of the upset.

14. The method as claimed in claim 13 further comprising shifting a selected frac sleeve, the selection being by virtue of the space uphole of the upset.

15. The method as claimed in claim 13 further comprising, adjusting the dart by selecting the space uphole of the upset.

16. The method as claimed in claim 15 wherein the selecting is by adding a spacer to the dart.

17. The method as claimed in claim 13 wherein the moving and releasing is automatic.

18. A wellbore system comprising:

a borehole in a subsurface formation;

a string in the borehole; and a dart as claimed in claim 1 disposed in the borehole.

* * * * *